US008757626B2

(12) United States Patent
Acker

(10) Patent No.: US 8,757,626 B2
(45) Date of Patent: Jun. 24, 2014

(54) SELF SEALING TARGET

(75) Inventor: Blair Acker, Howell, MI (US)

(73) Assignee: Arrowmat, LLC, Howell, MI (US)

( * ) Notice: Subject to any disclaimer, the term of this patent is extended or adjusted under 35 U.S.C. 154(b) by 277 days.

(21) Appl. No.: 13/092,204

(22) Filed: Apr. 22, 2011

(65) Prior Publication Data

US 2011/0260405 A1 Oct. 27, 2011

Related U.S. Application Data

(60) Provisional application No. 61/327,157, filed on Apr. 23, 2010.

(51) Int. Cl.
*F41J 3/00* (2006.01)

(52) U.S. Cl.
USPC ..... 273/403; 273/408

(58) Field of Classification Search
USPC ..... 273/403, 404, 407, 408; 428/40.1
See application file for complete search history.

(56) References Cited

U.S. PATENT DOCUMENTS

| | | | | |
|---|---|---|---|---|
| 747,710 | A | 12/1908 | Hollifield | |
| 3,088,738 | A | 5/1963 | Meyer | |
| 3,170,832 | A | 2/1965 | Wilson | |
| 3,367,660 | A | 2/1968 | DiMaggio | |
| 3,476,390 | A | 11/1969 | Roloff | |
| 3,516,670 | A | 6/1970 | D'Agostino | |
| 3,762,709 | A | 10/1973 | Roloff et al. | |
| 4,066,261 | A * | 1/1978 | Stewart | 273/403 |
| 4,082,280 | A | 4/1978 | Lang | |
| 4,235,444 | A | 11/1980 | Meyer | |
| 4,456,264 | A | 6/1984 | Detwiler | |
| 4,462,598 | A * | 7/1984 | Chalin et al. | 273/378 |
| 4,546,984 | A * | 10/1985 | Towle et al. | 273/404 |
| 4,643,434 | A * | 2/1987 | Carlin | 273/408 |
| 4,695,060 | A * | 9/1987 | Pilgrim | 273/404 |
| 4,850,596 | A * | 7/1989 | Olund | 273/408 |
| 5,354,066 | A * | 10/1994 | Swanson et al. | 273/408 |
| 5,460,873 | A * | 10/1995 | Ogawa et al. | 428/316.6 |
| 5,820,968 | A | 10/1998 | Kurani | |
| 5,924,694 | A * | 7/1999 | Kent | 273/408 |
| 6,435,512 | B1 * | 8/2002 | Beckwith, Sr. | 273/407 |
| 7,258,345 | B2 | 8/2007 | Anderson, Jr. | |
| 7,461,894 | B2 * | 12/2008 | Leeds | 297/229 |
| 2002/0136851 | A1 * | 9/2002 | Kollaja et al. | 428/40.1 |
| 2004/0036221 | A1 * | 2/2004 | Martinez | 273/373 |
| 2008/0061509 | A1 * | 3/2008 | Potterfield | 273/403 |
| 2009/0096172 | A1 * | 4/2009 | Beschorner | 273/408 |
| 2012/0080848 | A1 * | 4/2012 | McGovern et al. | 273/408 |

OTHER PUBLICATIONS

American Whitetail, Inc. Complete Target Systems Archery Targets of the 90's, 3 pages, excluding recent commentary, undated.

* cited by examiner

*Primary Examiner* — Mark Graham
(74) *Attorney, Agent, or Firm* — Gifford, Krass, Sprinkle, Anderson & Citkowski, P.C.

(57) ABSTRACT

A target for use as an archery or firearm target constructed of a material which provides self-sealing as the target is being used to thereby make the target capable of repeated use.

5 Claims, 1 Drawing Sheet

SELF SEALING TARGET

CROSS-REFERENCE TO RELATED APPLICATIONS

This Application claims the benefit of U.S. Provisional Application 61/327,157 filed on Apr. 23, 2010.

FIELD OF THE INVENTION

The present invention relates to targets and more particularly to an archery and/or firearm target which is self sealing so that it is capable of repeated use.

BACKGROUND OF THE INVENTION

Archery and firearm targets heretofore have been generally paper targets not capable of repeated re-use and were commonly used once or twice and then discarded. Foam block targets as well as other targets capable of capturing and retaining the arrow such as targets constructed of foam beads and soft foam materials of the type used in carpet padding have been provided for either receiving a paper target or one constructed of similar low usage material. Targets are also provided in the form of paint or inks disposed directly of the face of a foam block or similar material. Targets which are adhered to the surface of the block as well as those which are applied directly to the face of the block will deteriorate after use and although the foam block remains intact the target is no longer useful after a very limited number of hits.

SUMMARY OF THE INVENTION

The present invention provides a target primarily for use as an archery target but which can be also used as a firearm target. The target is constructed of a small cell cellular plastic or rubber material such as open cell styrene butadiene and with an outer layer of soft polyester or neoprene therefore is sufficiently self sealing so that the target is capable of being used a multiple number of times. The target face is formed on the polyester or neoprene layer by a process known as dye sublimation which permits vibrant colors and adherence through multiple uses of the target.

BRIEF DESCRIPTION OF THE DRAWINGS

A better understanding of the present invention will be apparent upon reference to the following drawings in which.

DETAILED DESCRIPTION OF THE PREFERRED EMBODIMENTS

Figure 1:
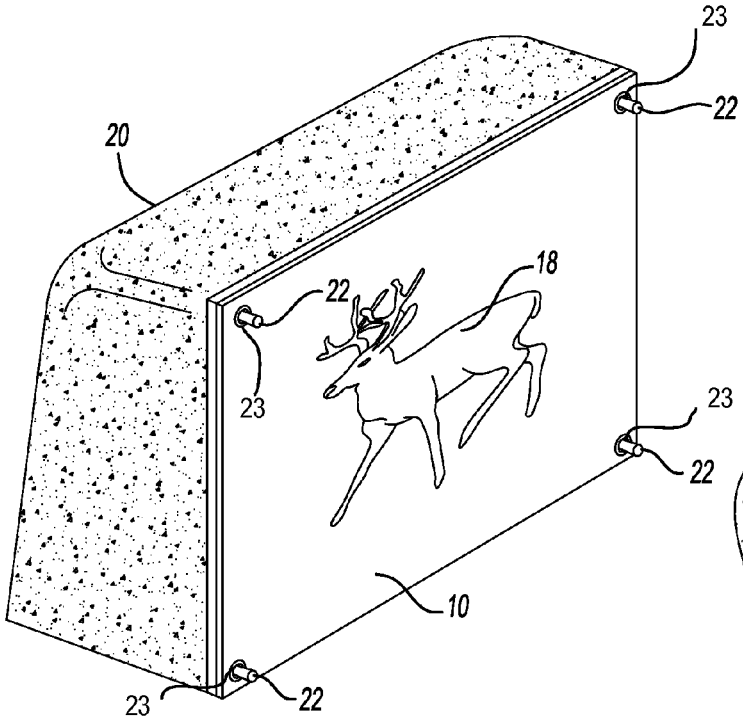
FIG. 1 is perspective view of one embodiment of the target of the present invention attached to a target block.
Figure 3:
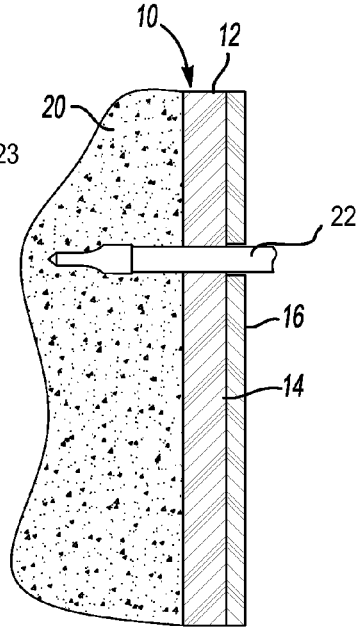
FIG. 3 is a cross sectional view of a fragmentary portion of FIG. 1.
Figure 2:
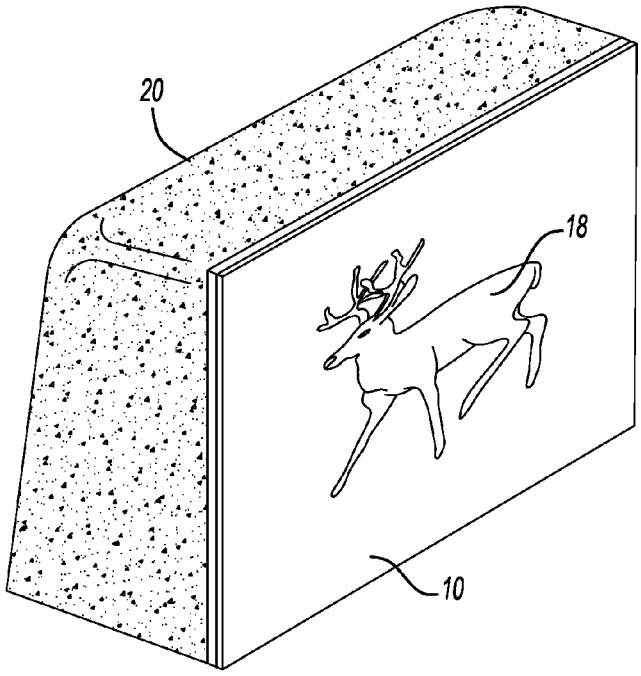
FIG. 2 is another view of the present invention similar to FIG. 1 but illustrating another preferred embodiment of the present invention.
Figure 4:
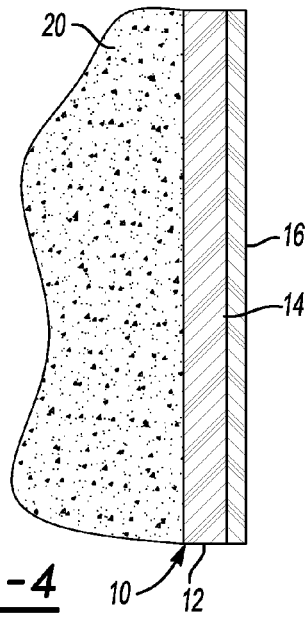
FIG. 4 is a cross sectional view of a fragmentary portion of FIG. 2.

As shown in the drawings the target 10 of the present invention is similar in appearance to an ordinary paper archery target but is instead constructed of a self sealing material so that it is capable of repeated use. It has been found that the target can be used as an archery target over 1000 times before it needs to be replaced. This repeated use is made possible by the material used to produce the target. The preferred material indicated by reference numeral 12 as seen in FIGS. 3 and 4 is a small cell, cellular plastic or rubber or the like such as open cell styrene butadiene rubber (SBR) foam or open cell styrene. The outer face 14 of the material 12 is covered with a layer 16 of soft polyester such as the fabric sold under the registered trademark Origin'L fabric. Neoprene can also be used for the layer 16. The fabric layer 16 acts to hold the material 12 together to form a target 10 which tends to self seal as the arrow (not shown) is removed from the target 10. An image 18 as shown in FIGS. 1 and 2 is provided on the fabric layer 16 of the target 10 preferably by a "dye sublimation process." Such a process uses heat to transfer the image 18 to the fabric layer 16 of the target 10 chemically so that the image 18 remains through repeated use. The combination of the self sealing material 12 and the manner in which the image 18 is applied to the target material 16 permits repeated use of the target 10.

As shown in FIGS. 1 and 3 the target 10, in one form, is designed to be attached to a foam block 20 by conventional attaching means 22. Grommets 23 are formed in the corners of the target 10 to receive the attaching means 22 to mount the target 10 to the block 20. Because the target 10 can be used repeatedly and would in most cases outlast the life of a prior art image (not shown) applied to the foam block 20 it can, instead of being attached to the block 20 by attaching means 22, be affixed to the block 20 in a more permanent fashion such as by being imbedded in the block 20 as a part of the process of forming the block 20 or it could be glued directly to the foam block 20 as in FIG. 4.

Although the present invention has been described as being useful in combination with a foam block 20 it should be apparent that materials other than foam could be used as a block as well. All that is necessary is that the block 20 have the ability to absorb the impact of the arrow and prevent it from passing through the block Although the target of the present invention has been described as useful as an archery target it is apparent that the target disclosed could with minor variations be also used as a firearm target.

It is also apparent that although two embodiments of the present invention have been described changes to the embodiments could be made without departing from the spirit of the invention and from the scope of the invention as set forth in the appended claims.

The invention claimed is:

1. A target apparatus consisting of a target body, a single self-sealing layer, and a single fabric layer, the target body including at least a face and being constructed of a material capable of slowing a projectile passing through said body, the self-sealing layer having an inner surface and an outer surface, the self-sealing layer being attached to the target body so that the inner surface of the self-sealing layer is opposite the face of the target body, and the fabric layer having an inner surface adhered to the outer surface of the self-sealing layer and an outer surface including an image, and in which the self-sealing layer is selected from a group consisting of open cell styrene butadiene rubber foam and open cell styrene, and the fabric layer is selected from a group consisting of polyester and neoprene, and said self-sealing layer and fabric layer being provided with grommets at its corners and said self-sealing layer and fabric layer being attached to said target body by fasteners extending through said grommets and into said body.

2. The target apparatus as defined in claim 1 and in which said target body is a foam block.

3. A target apparatus consisting of a target body and a single self-sealing layer, the target body including a face to be struck by a projectile and being constructed of a material capable of retaining a projectile passing through said body, the self-sealing layer having an inner surface and an outer surface and being removably attached to the target body so that the inner surface of the self-sealing layer is opposite the face of the target body, and the self-sealing layer having a fabric layer adhered to the outer surface of the self-sealing layer, and the fabric layer including an image on the side of the fabric layer opposite the self-sealing layer, and in which the self-sealing layer is selected from a group consisting of open cell styrene butadiene rubber foam and open cell styrene, and each fabric layer is selected from a group consisting of polyester and neoprene.

4. The target apparatus as defined in claim 3 and in which said target body is a foam block.

5. A target apparatus consisting of a single self-sealing layer and a single fabric layer, the self-sealing layer having a first and a second surface, and the fabric layer having a first surface adhered to the second surface of the self-sealing layer and a second surface including an image, and in which the self-sealing layer is selected from a group consisting of open cell styrene butadiene rubber foam and open cell styrene, and the fabric layer is selected from a group consisting of polyester and neoprene, and the apparatus having a predetermined shape with corner apertures surrounded by grommets through which a fastener may pass to permit the apparatus to be removeably mounted to a target body.

* * * * *